United States Patent [19]

May

[11] Patent Number: 4,462,020

[45] Date of Patent: Jul. 24, 1984

[54] MINIATURE RESISTIVE TEMPERATURE DETECTOR AND METHOD OF FABRICATION

[75] Inventor: E. Glenn May, Melbourne, Fla.

[73] Assignee: Harris Corporation, Melbourne, Fla.

[21] Appl. No.: 296,191

[22] Filed: Aug. 25, 1981

[51] Int. Cl.[3] ..... H01C 3/04

[52] U.S. Cl. ..... 338/25; 29/612; 338/261; 338/302; 338/299

[58] Field of Search ..... 338/25, 260, 261, 264, 338/320, 267, 270, 256, 302; 29/612, 618; 73/381

[56] References Cited

U.S. PATENT DOCUMENTS

| | | | |
|---|---|---|---|
| 2,287,460 | 6/1942 | Wagenhals et al. | 29/618 X |
| 2,589,521 | 3/1952 | Wheeler et al. | 29/618 X |
| 3,083,445 | 4/1963 | Hill | 338/264 X |
| 3,343,114 | 9/1967 | Rice | 338/22 |
| 3,440,589 | 4/1969 | Minks | 338/25 X |
| 3,781,749 | 12/1973 | Iles et al. | 338/25 |
| 3,845,443 | 10/1974 | Fisher | 338/25 |
| 3,939,557 | 2/1976 | Rendle | 338/25 X |

*Primary Examiner*—C. L. Albritton

*Attorney, Agent, or Firm*—Barnes & Thornburg

[57] ABSTRACT

A miniature resistive temperature detector is fabricated by winding wire about a ceramic, or equivalent, cement coated graphite mandrel or form having a greater length than the resulting detector, coating the wire except for the lead portion with a ceramic, or equivalent, cement and cutting the wire and breaking the form to produce the miniature detector. A plurality of miniature detectors may be fabricated on a single form or mandrel with space between each detector to facilitate breaking.

16 Claims, 6 Drawing Figures

FIG.1
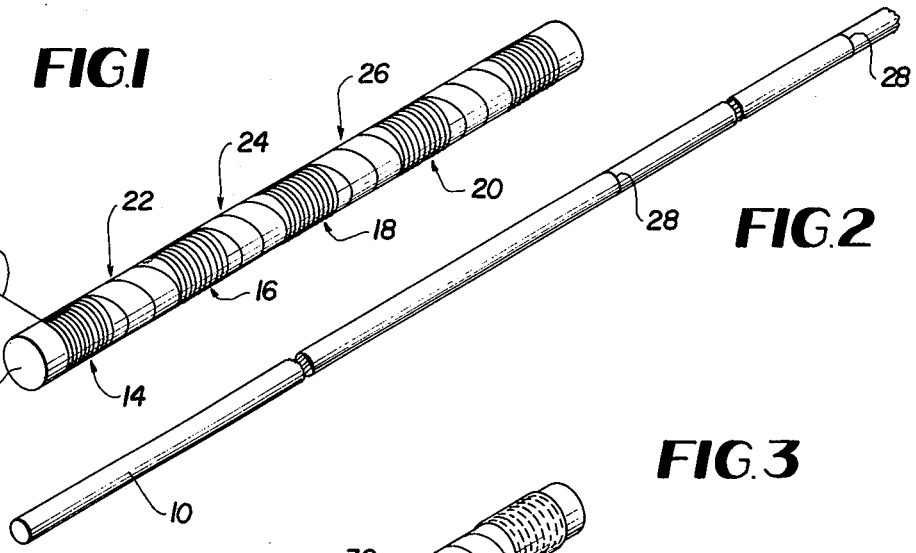
FIG.2
FIG.3
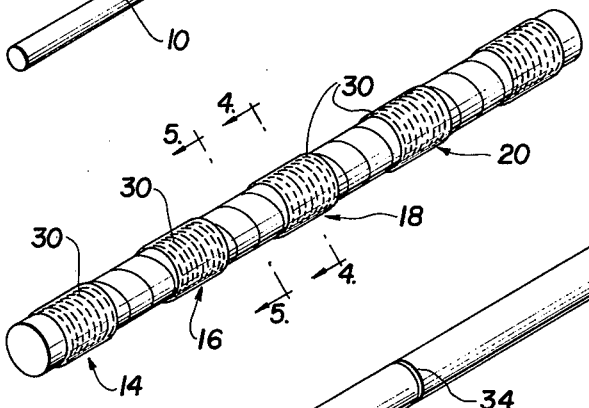
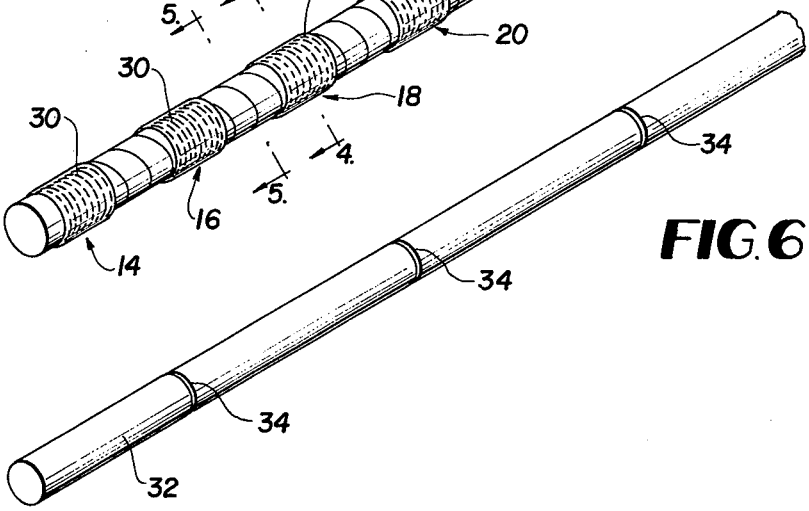
FIG.6
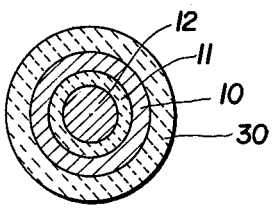
FIG.4
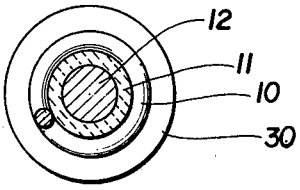
FIG.5

MINIATURE RESISTIVE TEMPERATURE DETECTOR AND METHOD OF FABRICATION

BACKGROUND OF THE INVENTION

The present invention relates generally to resistive temperature detectors and more specifically to a method of making miniature wound wire resistive temperature detectors.

In the semiconductor industry, it is desirable for testing purposes to include a temperature detector within a die packaged cavity. Heretofore these temperature detectors have included semiconductor devices, for example, thermistors or diodes formed in a substrate or thin film resistors formed on the substrate. Process for forming these temperature detectors is compatible with other device forming techniques and thus is readily achieved while forming other devices in the integrated circuit.

In other environments, inexpensive temperature detectors have been used which include wrapping a resistive wire about a mandrel or form wherein the resistance of the wire changes with temperature. These devices are relatively inexpensive and may be produced without expensive equipment and time used to form temperature detectors on an integrated circuit. These wound resistors are relatively large and have not been made small enough to be used in a die cavity. The limitation of size is produced by the requirement to handle the mandrel or form during the winding operation. Special equipment to handle a form within the range of less than five hundredths of an inch diameter and lengths of less than one-tenth of an inch would require expensive and specially designed equipment. Similarly, in the past, the mandrel or form has generally been ceramic which requires molds or other special processing to produce each desired or specially designed form or mandrel. This special design for each individual case makes the wound wire temperature detector economically unfeasible to be produced small enough to be used in a die package cavity.

SUMMARY OF THE INVENTION

An object of the present invention is to provide a wound wire resistive temperature detector capable of being used in a die package cavity.

Another object of the present invention is to provide a method for economically producing wound wire resistive temperature detectors in miniature sizes.

Still another object of the present invention is to provide a wound wire resistive temperature detector of high accuracy and manufacture repeatability.

Still a further object of the present invention is to provide a method of economically producing a miniature wound wire resistive temperature detector.

Still even a further object of the present invention is to provide an economic wound wire resistive temperature detector which is small enough to be used in a die package cavity and is capable of withstanding the environment therein.

These and other objects of the invention are attained by winding a wire about a form or mandrel of substantial greater length than the temperature detector, coating the wound wire with ceramic cement except at the leads and breaking the form or mandrel to produce the miniature detector. Preferably, the form or mandrel is ceramic, or equivalent, cement coated graphite so that the breaking may take place without prior processing, for example, scribing. The same process may be used to form a plurality of resistive temperature detectors on a single form or mandrel with sufficient space between the plurality of wrapped sections to facilitate cutting of the wires and breaking of the mandrel or form. The wire may be marked to also facilitate cutting of the wire and locating the point which the mandrel or form would be broke. If a ceramic form or mandrel is used, it is pre-scribed to facilitate breaking. This method allows the fabrication of wound wire resistive temperature detectors on a mandrel or form having a diameter less than five hundredths of an inch and the resulting detector having a length of less than one-tenth of an inch without the use of specialized winding equipment or expensive production equipment for the mandrel or form.

BRIEF DESCRIPTION OF THE DRAWINGS

FIG. 1 is a perspective view of a mandrel having wire wrapped thereon according to the principles of the present invention.

FIG. 2 is a perspective view of a wire marked at specific intervals according to the principles of the present invention.

FIG. 3 is a perspective view of the wrapped mandrel of FIG. 1 having the resistive temperature detectors coated with a ceramic cement according to the principles of the present invention.

FIG. 4 is a cross-sectional view taken along lines 4—4 of FIG. 3.

FIG. 5 is a cross-sectional view taken along the lines 5—5 of FIG. 3.

FIG. 6 is a perspective view of a ceramic mandrel or form scribed according to the principles of the present invention.

DESCRIPTION OF THE PREFERRED EMBODIMENTS

The materials of the present wound wire resistive temperature detector are depended upon the environment in which the detector is to be used. In the past, the mandrel or form for low temperatures have included glass and for high temperatures have included ceramics. As discussed previously, these forms or mandrels must be individually manufactured depending upon the final dimensions required. Since the method of the present invention includes wrapping wire about a mandrel or form substantially greater than the size of the final resulting detector, it is desirable to use a form material which is readably broken to produce a clean break at a point and is capable of withstanding severe environments. The material which is inexpensive and meets these requirements is coated graphite or pencil lead which is readily available in many different diameters. Since graphite is a conductor, it must be coated with a high temperature insulator such as ceramic cement or its equivalent. The coating should be sufficiently thick to provide electrical insulation between the graphite mandrel or form and the wire wrapped thereon while not substantially increasing the diameter of the mandrel or form.

The process of the present invention begins by wrapping resistive wire about a mandrel or form. As illustrated in FIG. 1, the wire 10 is wrapped about a mandrel or form 12. The wrapping is performed to produce a plurality of resistive temperature detectors 14, 16, 18 and 20 spaced along the mandrel or form 12 with separations 22, 24, 26 therebetween. The wire traversing the separations 22, 24 and 26 will be the resulting leads of the individual resistive temperature detectors. By providing the spaces 22, 24, 26 on the mandrel or form between the individual detectors, the wires are readably cut and the mandrel or form is readily broken to form the individual detectors.

Once resistance of the desired detector is known, a wire having a resistance per unit length capable of producing the miniature size requirements for a die package cavity is selected and the resulting distance is calculated. An additional length of wire is added to this calculated length to allow adjustment of the final resistance. This resulting length is then measured on the supply wire and marked as illustrated in FIG. 2. This wire 10 is marked at intervals as indicated by indicia 28. This marking may be produced by scribing the wire, painting or breaking of the insulation if an insulated wire is used. These markings will aid the wrapping process to produce the spacing between a plurality of simultaneously wrapped detectors as well as facilitating the point at which the continuous wire is to be cut to form the individual detectors. Alternatively, knowing the resistance per unit length and the diameter of the form or mandrel 12, the number of turns needed to produce the desired resistance can be calculated and the space between the individual detectors may be produced at the appropriate number of turns.

The next step in the process of the present invention includes coating the individual resistive temperature detectors with a ceramic or thermal layer 30. As illustrated in FIG. 3, the detectors 14, 16, 18 and 20 themselves are coated with a ceramic cement 30 and the leads or the space between the individual resistive detectors are not coated with the ceramic cement. The difference between the areas coated and not coated with ceramic cement are illustrated in the cross-sections of FIGS. 4 and 5. Also illustrated in FIGS. 4 and 5 is a graphite mandrel or form 12 coated with a ceramic cement or equivalent layer 11. The ceramic cement, for example, Dylon Grade C7 or equivalent, is a good thermal conductor and thus does not effect the response of the wire to temperature while providing a protective cover for the wire at the graphite. Since most wires are coated with a material which will vaporize at the ceramic package sealing temperatures and at wire annealing temperatures, the ceramic coating is necessary.

The ceramic cement 30 may be provided only on the detectors 14, 16, 18 and 20 by perfectly masking the spaced areas 22, 24, 26. The ceramic is applied by brushing, spraying or other well-known techniques. The mask may be a template or a masking material may be applied. If a masking material is applied, appropriate process steps will include removing the mask. It should be noted that the masking material or its removing step should not adversely affect the wire 10 or the mandrel or form 12.

After the plurality of resistive temperature detectors are coated with a ceramic cement 30, the wire 10 is cut at the appropriate intervals and the mandrel or form 12 is broken to produce the individual detectors. The individual detectors are then ready for calibration and use. In the preferred use, the detectors are mounted with a die cavity. One lead is mounted to a terminal of the package of the die cavity. The resistance of the detector is then monitored to determine the length of the second lead which will produce the desired total resistance of the detector. Once this length is determined, the second lead is bonded to a second terminal at this length to produce the final resistance of the detector. This method of calibration allows the fabrication method to be performed without a high degree of accuracy of the total resistance of the detector as long as sufficient length is provided at the leads to allow calibration of the finally produced resistive temperature detector.

Although the present process has been described for fabricating a plurality of miniature wound wire resistive temperature detectors, a single detector may be produced by the described process. The important factor is that the wire is wound about a mandrel or form which is substantially greater than the length of the finally to be produced temperature detector. The length of the original form should be large enough to allow ease of handling. Although automatic winding equipment may be used with the relatively long form, a simple hand drill may also be used to produce the appropriate rotation of the form.

The preferred wire for use in the present invention is platinum although other types of wires may be used. Although the wire is available in hard drawn bare, annealed bare and hard drawn insulated, the preferred embodiment uses the hard drawn insulated wire. The insulation provides spacing between the wires during the wrapping process even though the insulation is vaporized during subsequent assembly processes as described above. The hard drawn state greatly lessens manufacturing problems such as stretching or breaking. It should be noted that the ceramic cement is capable of withstanding the high temperature required to anneal the hard drawn wire after it is wrapped.

If for certain environments, the graphite is not an appropriate mandrel or form, ceramic forms or mandrels may be used. As illustrated in FIG. 6, a ceramic mandrel or form 32 must be scribed as at 34 to define the individual miniature detectors. This allows the ceramic mandrel of form 32 to be readily broken along a single plane without shattering or breaking. As discussed previously, graphite is preferred since it may be broken along a plane without shattering without the need for prior processing such as scribing.

From the preceding description of the preferred embodiment, it is evident that a method is provided which will produce a miniature wound wire resistive temperature detector which can be economically produced in miniature sizes. The importance of the detector having a length of less than one-tenth of an inch and a diameter of less than five hundredths of an inch is for its use in a die package cavity. Heretofore, temperature monitoring of die package cavities have only been capable with thin film or diffused temperature elements in the IC. In most cases, the device should be as small as five hundredths of an inch in length and having a diameter of three hundredths of an inch.

One process in which the miniature detector may be used is to determine the soak time for an IC package. This time is the time needed during testing for a die inside of a package to reach the environmental temperature. The die is replaced in the package with the resistive temperature detector. If the resistive temperature detector were greatly larger in volume than was the die, than the soak time would be made longer by the increase in volume. Not only would this increase the time required for tying up the expensive test equipment, but would also produce inaccurate results. With the present process, the resistive temperature detector size may be made as small as the small die sizes. For larger dies, more ceramic cement may be provided to increase the volume of the detector without necessarily increasing the resistance of the resistive temperature detector.

Although the present invention has been described and illustrated in detail, it is clearly understood that the same is by way of example and illustration only and not to be taken by way of limitation. The spirit and scope of the present claims are to be limited only by the terms of the appended claims.

What is claimed is:

1. A resistive temperature detector comprising a coated cylindrical graphite form, a wire wound about said form and a ceramic cement covering said wire.

2. The resistive temperature detector according to claim 1 wherein said wire is platinum.

3. The resistive temperature detector according to claim 1 wherein said form has a length of less than one-tenth of an inch.

4. The resistive temperature detector according to claim 3 wherein said form has a diameter of less than five hundredths of an inch.

5. A method of fabricating miniature resistive temperature detectors comprising wrapping wire about a portion of a coated cylindrical graphite form, said form being breakable substantially along a plane without being scribed, and said form having a substantially greater length than the length of the to be produced detector, coating said wire with ceramic cement except for lead portions of said wire, and breaking the wrapped form portion from the remainder of the form to produce said detector.

6. The method according to claim 5 including forming a plurality of miniature resistive temperature detectors by the process of wrapping said wire around said form, covering said wire with ceramic cement except for the lead portion of each detector, cutting said wire and breaking said form at a plurality of points to produce a plurality of miniature detectors.

7. The method according to claim 6 wherein said wrapping is performed to leave space between adjacent detectors on said form to facilitate cutting said wire and breaking said form.

8. The method according to claim 7 including measuring a predetermined length of wire and marking said measured length to facilitate cutting said wire.

9. The method according to claim 5 wherein said wire is selected to be hard drawn insulated wire and including the step of annealing said wire after it is coated with said ceramic cement.

10. A method of fabricating miniature resistive temperature detectors comprising wrapping wire about a portion of a cylindrical form, said form being breakable at points along its length substantially along a plane perpendicular to its longitudinal axis, and said form having a substantially greater length than the length of the to be produced detector, coating said wrapped portion of said form with ceramic cement except for lead portions of said wire, and breaking the wrapped form portion from the remainder of the form to produce said detector without scribing said form subsequent to wrapping said form with said wire.

11. The method according to claim 10 including forming a plurality of miniature resistive temperature detectors by the process of wrapping said wire around said form, covering said wire with ceramic cement except for the lead portion of each detector, cutting said wire and breaking said form at a plurality of points to produce a plurality of miniature detectors.

12. The method according to claim 11 wherein said wrapping is performed to leave space between adjacent detectors on said form to facilitate cutting said wire and breaking said form.

13. The method according to claim 12 including measuring a predetermined length of wire and marking said measured length to facilitate cutting said wire.

14. The method according to claim 10 wherein said wire is selected to be hard drawn insulated wire and including the step of annealing said wire after it is coated with said ceramic cement.

15. The method according to claim 10 wherein said form is a ceramic, said form being scribed at points along its length prior to being wrapped with said wire to facilitate breaking of said form substantially along a plane subsequent to being coated with said ceramic cement.

16. The resistive temperature detector according to claim 1 wherein said wire is platinum alloy.

* * * * *